US007744745B2

(12) United States Patent
Alvarenga Baptista et al.

(10) Patent No.: US 7,744,745 B2
(45) Date of Patent: Jun. 29, 2010

(54) PROCESS FOR FLUID CATALYTIC CRACKING OF HYDROCARBON FEEDSTOCKS WITH HIGH LEVELS OF BASIC NITROGEN

(75) Inventors: Claudia Maria de L. Alvarenga Baptista, Rio de Janeiro (BR); Elizabeth M. Moreira, Rio de Janeiro (BR); Henrique Soares Cerqueira, Rio de Janeiro (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 0 days.

(21) Appl. No.: 12/166,779

(22) Filed: Jul. 2, 2008

(65) Prior Publication Data

US 2009/0084708 A1 Apr. 2, 2009

Related U.S. Application Data

(63) Continuation of application No. 11/513,020, filed on Aug. 31, 2006, now abandoned, which is a continuation of application No. 10/689,662, filed on Oct. 22, 2003, now abandoned.

(51) Int. Cl.
*C10G 11/18* (2006.01)

(52) U.S. Cl. ..... 208/113; 208/118; 208/120.05; 208/120.1

(58) Field of Classification Search ..... 208/113
See application file for complete search history.

(56) References Cited

U.S. PATENT DOCUMENTS

| | | | | |
|---|---|---|---|---|
| 2,767,126 | A * | 10/1956 | Rice | 208/74 |
| 4,167,474 | A * | 9/1979 | Sikonia | 208/140 |
| 4,818,372 | A * | 4/1989 | Mauleon et al. | 208/113 |
| 4,830,728 | A * | 5/1989 | Herbst et al. | 208/78 |
| 4,853,105 | A * | 8/1989 | Herbst et al. | 208/74 |
| 4,927,522 | A * | 5/1990 | Herbst et al. | 208/120.01 |
| 2001/0025806 | A1 * | 10/2001 | Steffens et al. | 208/113 |
| 2002/0003103 | A1 * | 1/2002 | Henry et al. | 208/106 |

* cited by examiner

*Primary Examiner*—Tam M Nguyen
(74) *Attorney, Agent, or Firm*—Nixon & Vanderhye P.C.

(57) ABSTRACT

A process is described for fluid catalytic cracking of hydrocarbons with high levels of basic nitrogen, where hydrocarbon feedstocks A and B with different levels of basic nitrogen are injected in a segregated fashion, into different risers of a multiple riser FCCU that possesses at least two risers. The injection of the feedstocks is made in such a way that feedstock A, to be injected in the riser with greater volume—main riser 7—possessing a level of basic nitrogen at least 200 ppm lower than the level of feedstock B to be injected into the riser with lower volume—secondary riser (8).

26 Claims, 1 Drawing Sheet

State of the Art

State of the Art

PROCESS FOR FLUID CATALYTIC CRACKING OF HYDROCARBON FEEDSTOCKS WITH HIGH LEVELS OF BASIC NITROGEN

This application is a continuation of U.S. application Ser. No. 11/513,020 filed Aug. 31, 2006, now abandoned, which is a continuation of U.S. application Ser. No. 10/689,662, filed Oct. 22, 2003, now abandoned, and the claims the benefit of priority to Brazilian Application No. 0205585-6 filed Oct. 29, 2002, the entire contents of which are incorporated by reference in this application.

FIELD OF THE INVENTION

The present invention relates to a process for fluid catalytic cracking (FCC) of hydrocarbon feedstocks with high levels of basic nitrogen in FCC units (FCCU) provided with multiple conversion zones (risers). More specifically, the invention relates to a process for fluid catalytic cracking of hydrocarbon feedstocks with different levels of basic nitrogen, which uses a segregating route of said hydrocarbon feedstocks that are fed into different risers in the multiple risers FCCU.

BACKGROUND OF THE INVENTION

There have been ever increasing oil discoveries in Brazil that contain high concentrations of basic nitrogenous compounds, be they aromatic or polyaromatic, that may or may not be branched, with predominantly heterocyclic chemical structures, that are concentrated in high boiling point hydrocarbons fractions such as Heavy Gas Oil (HGO), Atmospheric Residue (AR), Vacuum Residue (VR), by-products of the distillation process, among others, such as Heavy Coker Gas Oil (HCGO), by-products of delayed coking units, and even deasphalted oil (DESO) a by-product of asphalt production units.

Basic nitrogenous compounds, when present in fluid catalytic cracking processing, feedstocks tend to promote deactivation of the catalyst acid sites and to increase the level of coke deposits on the catalyst, with the subsequent loss of product conversion and selectivity in the process.

Fluid catalytic cracking (FCC) is performed by the contact of hydrocarbons in a reaction zone with a catalyst made up of fine particulate matter. Feedstocks that are commonly submitted to FCC processing are, usually, petroleum refinery process streams that come from longitudinally segmented vacuum towers, called Heavy Vacuum Gas Oil (HVGO), streams coming from delayed coking units, Heavy Coker Gas Oil (HCGO) or, heavier that the former, coming from the bottom of atmospheric towers, Atmospheric Residue (AR), or even mixtures of these feedstocks.

These streams, that typically have a density in the range of 8 to 280 API, must be chemically processed using a process such as the catalytic cracking process, which fundamentally alters its composition, converting them into lighter, more valuable hydrocarbon streams.

During the cracking reaction, substantial portions of coke, a by-product of the reaction, are deposited on the catalyst. Coke is a material of high molecular weight, made up of hydrocarbons containing, typically, from between 4 and 9% of its compositional weight in hydrogen. The catalyst covered with coke, usually called "spent catalyst" by the specialists in the field, is continually removed from the reaction zone and is substituted with catalyst that is essentially free of coke from the regeneration zone.

In the regeneration zone and in a regenerator vessel kept at high temperature, the coke deposited on the surface and on the pores of the catalyst is burned off. Removing the coke through its combustion allows for a recovery of the catalyst activity and frees heat in sufficient amount to fulfill the thermal requirements for catalytic cracking reactions. The fluidization of the catalyst particles by gaseous feeds allows the catalyst to be transported between the reaction zone and the regeneration zone and vice-versa. The catalyst, aside from fulfilling its main function of expediting the catalyzation of chemical reactions, as well as providing a method for transporting heat from the regenerator to the reaction zone.

The technique contains many descriptions of hydrocarbon cracking processes in a fluidized catalyst feed, with catalyst transported between the reaction zone and the regeneration zone, and coke burning in the regenerator.

In spite of the long-time existence of the FCC process, techniques to improve the process have continually been sought to increase the production of derivatives of greater aggregate value, such as Naphtha and LPG. Generally speaking, it could be said that the main purpose of FCC processes is to maximize the production of these more valuable derivatives.

This maximization is basically obtained in two ways. First, by increasing the so-called "conversion" used to reduce the production of heavy products such as clarified oil and light recycled oil. And second, by reducing the production of coke and combustible gas, in other words, less "selectivity" towards these products.

A lower production of these last two products, besides expediting an increase in the production of gasoline and LPG, by increasing the process selectivity towards these derivatives, provides as a result the additional benefit of lower air blower and wet gas compressor use (machines with a high deadweight and large power consumption), which in turn usually cause a limitation of the FCCU capacity.

It is well known that an important aspect of the process and the initial contact of the catalyst with the, feedstock that exerts a decisive influence on the conversion and the selectivity of the process in generating noble products. In the FCC process, the feedstock of preheated hydrocarbons is injected next to the base of a conversion zone or riser, where it enters into contact with the flow of the regenerated catalyst, from which it receives sufficient heat to vaporize it and supply the demand of the endothermic reactions that dominate the process.

After the riser, (which is an elongated vertical pipe whose dimensions, in industrial units, are around 0.5 to 2.0 m in diameter by 25 to 40 m high, and is where chemical reactions occur) the spent catalyst, with coke still deposited on its surface and pores, is separated from the reaction products and is sent to the regenerator in order to burn off the coke so as to restore its activity and to generate the heat that, transferred by the catalyst to the riser, will be used by the process.

The conditions existing at point of the feedstock's entry into the riser are determined by how many products are formed in the reaction. In this area an initial mixture occurs of the feedstock with the regenerated catalyst, which has been heated to the boiling point of its components and to vaporization of the greater part of these components. The total residence time of the hydrocarbons in the riser is around 2 seconds. So that the catalytic cracking reactions may be processed, vaporization of the feedstock in the mixing area with the catalyst must occur rapidly, so that the vaporized hydrocarbon molecules may enter into contact with the catalyst particles—whose size is close to 60 microns—and permeate into its micro-pores, undergoing the effect provided by its acid sites in catalytic cracking. If this rapid vaporization is not achieved, thermal cracking will result of the feedstock's liquid fractions.

It is well known that thermal cracking leads to the formation of by-products such as coke and combustible gas, mainly in residual feedstock cracking. Coke, in addition to its low commercial value, obstructs the pores of the catalyst. Therefore, thermal cracking in the bed of the riser competes in an undesirable fashion with catalytic cracking, which is the purpose of the process.

Feedstock conversion optimization usually requires maximal removal of coke from the catalyst in the regenerator. Combustion of the coke may be obtained by partial combustion or total combustion. In partial combustion, the gases produced by combustion of the coke are principally made up of $CO_2$, CO and $H_2O$ and the percentage of coke in the regenerated catalyst is on the order of between 0.1% a 0.2% by weight. In this case of total combustion (performed in the presence of a great excess of oxygen), practically all of the CO produced has already reacted and been converted to $CO_2$. The oxidation reaction of CO to $CO_2$ is strongly exothermic, so that when this total combustion happens it releases a great amount of heat, resulting in very elevated regeneration temperatures. However, total combustion produces catalyst containing less than 0.07% and, preferably, less than 0.05% in weight of coke, making this feature more advantageous than partial combustion, in addition to precluding the need to use a burdensome boiler to combust the CO afterwards.

The increase in coke on the spent catalyst results in an increase in the coke combustion in the regenerator per unit of mass of circulated catalyst. Heat is removed from the regenerator in conventional FCC units in the combustion gas and mainly along the regenerated hot catalyst stream. An increase in the percentage of coke on the spent catalyst increases the temperature of the regenerated catalyst and the difference between the temperatures between the regenerator and the reactor.

Meantime, a reduction in the output of regenerated catalyst towards the reactor, (usually called circulation of the catalyst), is necessary in order to fulfill the thermal demand of the reactor and to maintain the reaction at a constant temperature. However, the lower catalyst circulation rate demanded by the great difference in temperature between the regenerator and the reactor, which results in a decrease in the catalyst/oil ratio, which in turn lowers the conversion.

So, the circulation of the catalyst in the regenerator towards the reactor is defined by the thermal demand of the riser and by the temperature established in the regenerator, (a function of the production of coke). Since coke that is generated in the riser is affected by the circulation of the catalyst itself, a conclusion may be drawn that the catalytic cracking process works under a system of thermal balance. However, (for the indicated reasons), very elevated temperatures are undesirable in the regeneration operation.

Usually, with modern FCC catalysts, the temperatures of the regenerator and, consequently, that of the regenerated catalyst, are kept below 760° C., preferably under 732° C., since the loss of activity would be very severe above this number. A desirable operational range is between 685° C. and 710° C. The lower value is dictated, mainly, by the need to guarantee proper combustion of the coke.

With the ever increasing weight of feedstocks processed, there is a trend towards raising the production of coke and the total combustion operation requires catalyst coolers to be installed in order to keep the temperature of the regenerator at acceptable limits. The catalyst coolers usually remove heat from the catalyst stream coming from the regenerator, returning to this vessel a substantially cooled catalyst stream.

As regards the fluid-dynamic characteristics of the riser, where the catalytic cracking reactions are processed of the present invention, what is known is that solid catalyst particles are dragged, by the reaction itself, during contact with the feedstock and other vaporized materials.

These types of reactors usually have the shape of a pipe where, in order to reduce the production of by-products, it is necessary to operate within a hydrodynamic stream system, in such a way as to allow the surface velocity of the gas to be either high or sufficient enough to cause the catalyst to flow in the same direction as the feedstock and the other vapors there existing. In other words, the liquid and vaporized feedstock drags the catalyst particles with it through the input passageway in the pipe reactor.

These stream systems are known by technicians in the field as fast fluidized bed, riser systems, or more generically as transport systems, which are the preferred systems when dealing with reaction systems that require continuous flow reactors.

Usually, for any given area in the cross section of a pipe reactor (which is a function of the diameter of the reactor itself), the concentration of the catalyst, in the fluidized bed of a reactor, decreases with an increase in the surface velocity of the gas. The greater the surface velocity of the gas, the greater the height required by the reactor to allow a given quantity of the feedstock to be able to contact the required amount of catalyst. These greater surface velocities (of the gas) require a higher L/D (Length/Diameter) ratio, or "aspect ratio" in the reactor. This ratio is the ratio between the height of the reactor and its diameter.

Additionally, in many cases, it may be desirable to build fluidized bed reactors with large cross section areas so that considerable feedstock output can be achieved with a single reactor. However, when the diameter of the fluidized bed is increased, particularly in the transport system, the height of the reactor must be increased as well. This increase in height is necessary because a certain minimum height is required in the reactor (L/D ratio) in order to achieve a fully developed flow pattern that is closer to the behavior of a continuous flow reactor.

However, fluidized bed reactors with an elevated L/D ratio are expensive, difficult to build and maintain because they must have very large and heavy separating tanks in the top, containing, in their interior, equally heavy equipment, that are targeted at capturing and controlling the catalyst flow and the products in the reactor.

Finally, FCC Units with multiple risers, may have small diameter feedstock conversion zones precisely due to having a multiplicity of risers and therefore are able to maintain an adequate L/D ratio to promote the necessary fully developed stream systems, with a reasonable reactor height.

The increase in participation of domestic petroleum, originating from the oil fields of Campos Basin, on the coast of the State of Rio de Janeiro, presents some technical problems regarding the refining of hydrocarbon feedstocks derived from these oils, especially when the presence of basic organic nitrogenous compounds compromises the performance of the catalysts used in the fluid catalytic cracking (FCC) process, the major supplier of gasoline, diesel and liquefied petroleum gas (LPG) for domestic consumption.

Basic organic nitrogenous compounds, present in petroleum, are predominantly, made up of the quinoline, benzoquinoline, alkylpyridines, amides, alkyl and hydroquinolines, acridines and phenanthridines families. Structurally, they are aromatic and polyaromatic heterocyclic compounds, that may or may not be branched, that accumulate on the heaviest fractions of crude oil in separation processes, mentioned above. Heavy gas-oil originating from Cabiunas petroleum oil may present about 1000 parts basic nitrogen per million (ppm).

Any refinery or specialist in the field of hydrocarbon feedstock refining will recognize the problems arising from the presence of basic nitrogenous compounds in the refinery process, especially in the FCC process: Basic nitrogenous compounds are responsible to a large extent for deactivation of the cracking catalysts, an increase in the level of coke, and gum formation in gasoline. In summary, all this represents a loss of capacity in the catalytic cracking unit with consequent great financial damage to the refinery.

In the first attempt to resolve this problem, or at least to minimize it, several refineries resorted to changing the catalyst used in the catalytic cracking units, in the search for a catalyst that would be more resistant to contamination through basic nitrogenous compounds. As the catalytic cracking catalyst in use in the great majority of refineries is made up of an acidic crystalline aluminosilicate—a zeolite, dispersed in a clay matrix, the poisoning of the catalyst by the basic nitrogenous compounds occurs precisely by the neutralization of the zeolite's acid centers that are, in the last analysis, the active centers for cracking the hydrocarbon molecules of the feedstock.

To overcome the deactivation caused by the basic nitrogenous compounds, many manufacturers of catalytic cracking catalysts have offered catalysts with a greater number of acid centers to their clients that come from a higher percentage of zeolite in the catalyst or by the use of acid matrices. Said resource may work well when the percentage of basic nitrogenous compounds in the hydrocarbon feedstock is low, or, when the basic nitrogenous compounds present have a low molecular weight.

It has been verified, in this last instance, that the basic nitrogenous compounds of low molecular weight only "poison" (in a reversible way), the acid centers of the catalyst and that, after the catalytic cracking catalyst regeneration stage, the activity of the cracking catalyst is restored, momentarily, until the catalyst thus regenerated enters again into contact with the hydrocarbon feedstock containing basic nitrogenous compounds. However, when basic nitrogenous compounds are made up of aromatic or polyaromatic compounds that are of a higher molecular weight, as is the case with the basic nitrogenous compounds present, for example, in CGOs, the deposit of the molecules of these basic nitrogenous compounds onto the surface of the catalyst particles is irreversible because it neutralizes the acid centers and reduces the specific area of the catalyst, that loses activity and selectivity. This is not, therefore, a good solution for fluid catalytic cracking units that process heavy feedstocks of hydrocarbons with these basic nitrogen characteristics.

Experimental studies performed on a multipurpose pilot FCC Unit of the Applicant, to evaluate the proposal of multiple injections in riser described in the patent CN 1088246 A, of the Petrochemical Research Institute of China Petrochemical Corp., for feedstock rich in contaminants, disclosed that said proposal was very advantageous in industrial FCC Units that process Coker Gas Oil, having a level of aromatic, resins, and basic nitrogenous compounds on the order of between 800 and 1000 ppm.

Studies of catalyst sampling in the risers of an industrial FCC Unit, described by Waldir Martignoni et al, in work presented at the Encontro Sul Americano de Refino, held in Manaus, AM, Brazil, in April of 2000, proved that the catalyst presents greater activity in first the 15 meters of the riser, where most of the conversion occurs in the process.

The injection of feedstocks considered refractory to cracking, as for example, CGOs, in positions above the traditional nozzle, where most of the process conversion has already occurred, increases, significantly, the process conversion of noble products.

In parallel fashion, studies of acid treatments of CGOs, performed at the work bench level in the laboratories of the Applicant's Research Center, according to concepts contained in patent PI 9803585-1 A, also belonging to the Applicant, disclosed that the basic nitrogenous compounds present in this CGO present a much more marked reactivity than the existing compounds in direct distilled heavy gas oil (DDHGO), a fact that would favor a more marked deactivation of the catalyst.

It is also known that Heavy Coker Gas Oil is a refractory feedstock in cracking, considering that HCGOs are a fraction derived from a thermal process. The Applicant performed runs in a prototype FCC Unit, with the feedstock output of 200 kg/h, proving a decrease in the process conversion, when the CGO fraction is mixed with the process feedstock, as will be shown in Example 1 of the present report.

In function of the greatest reactivity with the basic nitrogenous compounds present in HCGOs and of the lower crackability of this type of feedstock, in comparison with vacuum gas oil, if there were the possibility of adjusting differentiated operational conditions for HCGOs (mainly through the temperature of the reaction), it would be a promising alternative for the optimization of the industrial unit. This temperature adjustment would only be possible, if this stream were processed in a secondary riser of a FCC unit with two or more different risers.

Another benefit additional to the above achieved by said feedstock segregation would be that the segregated DDHGO might have the possibility of entering into contact with a more active catalyst in the main riser, due to the fact that the basic nitrogen present in the most contaminated feedstocks would not neutralize the acid sites of this catalyst in this riser, because it would be being fed into another secondary riser. This effect would be more pronounced than the effect observed with multiple injection feedstocks in the same riser.

U.S. Pat. No. 6,156,189 describes a type of alternate injection, in rapid feed cycles, made in the risers of pilot FCC Units with one or more risers, that, similar to the present invention, is presented as an alternative to the processing feedstock mixtures with different properties, when feedstocks with different properties are injected in the same riser. It should be emphasized that, industrially speaking, this procedure is an extremely complicated job, due to the fact that the patent description suggests alternating feeds in intervals or cycles of between 20 seconds and 2 minutes to achieve an increase in conversion.

Different from the State of the Art, the process of the present invention involves simultaneous processing, in fluid catalytic cracking units with multiple risers, of feedstocks containing different percentages of contaminants, especially contamination with basic nitrogen, where said feedstocks contaminated with the catalyst damaging basic nitrogen compounds are segregated into a secondary riser. Additionally, the present invention even includes the use of cooling streams in the secondary riser, to adjust the catalyst/oil (CTO) ratio in the risers.

The proposal of the present invention also guarantees that the acid sites of the catalyst in the main riser shall remain more active along the length of the riser, extending the beneficial effect theoretically achieved by U.S. Pat. No. 6,156,189.

Beyond the additional cited benefit, the fact that if segregated feedstocks are processed, this will allow for more operational flexibility, once the reaction temperature may be altered in each riser and the thermal balance modified, increasing the CTO in the risers.

So, despite the proposal literature, the technology for fluid catalytic cracking process still needs to involve simultaneous processing, in fluid catalytic cracking units, in multiple risers, for feedstocks containing different percentages of contaminants, especially of basic nitrogen, where the most contaminated feedstocks are segregated into secondary risers, these risers which are still cooled by cooling (quenching) fluids. A fluid catalytic cracking process that presents such features is described and claimed in the present application.

SUMMARY OF THE INVENTION

The present invention relates to process for fluid catalytic cracking of hydrocarbon feedstocks with high levels of basic nitrogen, in multiple riser FCCUs, operating with feedstocks A and B, where the process includes the following stages (steps):

a) place in contact with a zeolite catalyst, in the main riser of the FCCU, a hydrocarbon feedstock (a) possessing a level of basic nitrogen at least 200 ppm lower than feedstock (B) that is being processed in a secondary riser of the same FCCU;

b) simultaneously, place in contact with the same zeolite catalyst as in a), in a secondary riser of the FCCU, a hydrocarbon feedstock (B) that includes a mixture made up of between 95 and 40% in volume, of hydrocarbon streams with a percentage of catalyst damaging basic nitrogen between 1000 and 3500 ppm, and between 5 and 60% in volume, of a cooling fluid capable of increasing the circulation of this secondary riser and of cooling the regenerator, in order to adjust thermal balance of the FCCU and maintain the circulation of the catalyst in the main riser, at proper levels, so that the catalyst/oil ratio remains in the range of between 4.5 and 8.5;

c) maintain the operation of the FCCU within the conditions of catalytic cracking.

d) recover cracked reaction products with an increase in bottom conversion, a greater proportion of gasoline and LPG, at the same time reducing the proportion of coke and combustible gas.

Therefore, the invention provides the possibility of processing, simultaneously, in different risers in the same FCCU with multiple risers, segregated feedstocks of hydrocarbons, with different levels of basic nitrogen.

The invention still provides for the catalytic cracking processing of segregated feedstocks of hydrocarbons with different levels of basic nitrogen, which affords an optimization in the conversion selectivity rates of cracking.

The invention still provides for the catalytic cracking processing of segregated feedstocks of hydrocarbons with different levels of basic nitrogen where the production of coke and combustible gas is minimized, while the production of gasoline and LPG is maximized, resulting in a better economy of the FCC process.

The invention also provides for a process that will allow for more operational flexibility, once the reaction temperature may be altered in each riser and the thermal balance modified, increasing the CTO in both risers.

DETAILED DESCRIPTION OF THE PREFERRED EMBODIMENTS

Figure 1:
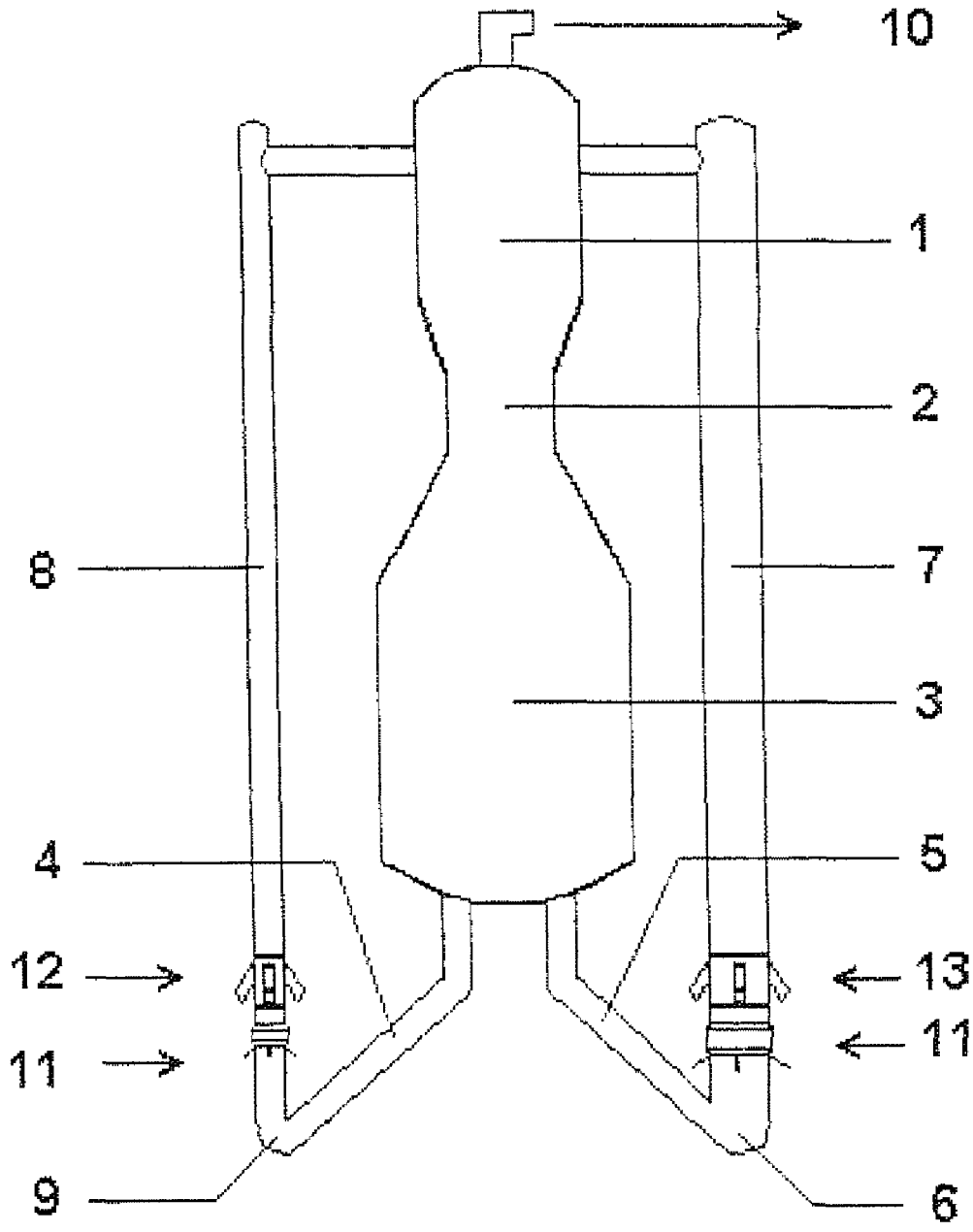
FIG. 1 attached is a simplified schematic drawing of a FCCU with multiple risers, useful in the process of the invention.

As used herein, the term "multiple riser" means that a FCC unit used in the process of the invention has at least two risers, and possibly, as needed by the cracking process, three risers.

Still according to the invention, feedstock A, to be cracked in the main riser, may include a mixture of various feedstock streams, in any proportion, as needed to keep the difference less than at least 200 ppm of basic nitrogen in feedstock A as compared with feedstock B. Feedstock A may be constituted of a pure stream or of a stream made of a combination of various streams.

The heavy hydrocarbon flow of feedstock A includes percentages of catalyst damaging basic nitrogen between 200 and 3500 ppm.

The present invention includes a process for the fluid catalytic cracking of heavy hydrocarbon feedstocks in FCC Units with multiple risers. The present process is especially targeted at FCC units that have, at least, two risers, with different diameters, in order to be able to process two segregated feedstocks with different levels of basic nitrogen.

The FCCU useful in the process of the invention is State of the Art equipment, used, for example, in U.S. Pat. No. 4,874,503.

Feedstock A with a lower level of basic nitrogen is fed into the main riser of the unit, in other words, in the riser with the greater diameter that allows a greater feedstock output. Feedstock B, which is rich in basic nitrogen, is segregated and fed, simultaneously, into a secondary riser, with a lower output.

The contact of the greater volume of the hydrocarbon feedstock in the main riser with the regenerated catalyst, free of the presence of compounds that neutralize the acid sites of the catalyst, favors process conversion and selectivity, since the basic nitrogen that is most damaging to the active sites of the catalyst, will be concentrated in the feedstock in the other "riser(s)".

Simultaneously, feedstock B (with its higher level of basic nitrogen), that is fed into a secondary riser, is processed together with a cooling fluid towards feedstock B.

The addition of this cooling fluid (that may or may not be inert), with the purpose of increasing the circulation in the secondary riser, due to the transient cooling effect in the riser, the unit gains control of the temperature of the riser. Being thus, so that a constant temperature may be maintained in the riser after introducing the cold stream, the catalyst intake valve towards the riser is opened, with the consequent automatic increase in circulation. The increase in circulation of the catalyst favors the cooling of the regenerator and consequently may guarantee that the circulation in the main riser will be maintained at the normally processed levels, in other words, a catalyst/oil ratio may be maintained within a range of between 4.5 and 8.5 in both risers.

The cooling fluid comprises between 5 and 60% in volume of the current feedstock B. The percentage that should be used depends on the type of fluid used. In this case of using an inert substance, like water, the percentage to be used will be lower, will not generate coke, which is one of cracking reaction products. Since the burning off of the coke is processed in the regenerator, the larger the amount of coke generated, the higher the temperature of the regenerator.

Generally the cooling fluid is a light hydrocarbon fraction with boiling point between 32 and 350° C. and with a density at 20/4° C. between 0.7 and 1. These hydrocarbons are usually comprised of hydrocarbons C1 to C5. Alternatively the cooling of the regenerator may be accomplished with the help of water.

It should be noted that the required concentration range of the cooling fluid in the secondary riser may seem to be too wide, but it reflects precisely the great difference that exists when the use is allowed of fluids whose intrinsic properties are as diverse as water and light hydrocarbon fractions. In other words, if the processing is performed with water, that does not react, in process conditions, barely a small proportion of same, between 5 and 10%, in volume, is capable of withdrawing the heat that must be taken out of the riser to not alter the thermal balance of the FCCU.

The same cannot be said when naphtha is used for example, which requires the addition of up to 60% in volume, in order to sufficiently cool the feedstock, requiring more volume for the same cooling delta and still some of the generated heat must be deducted that results from possible exothermic reactions that always occur in process conditions.

In each riser, hydrocarbons are cracked, leading to the deposit of the by-product coke on the catalyst that loses part of its activity. After the risers, a stream of cracked hydrocarbons is separated from the catalyst. The cracked hydrocarbons constitute the product of the reaction and are sent towards the fractioning systems.

The spent catalyst is sent to a rectifier vessel to recover any products of the reaction that would otherwise be dragged towards the regenerator together with the catalyst. Right away, the catalyst is fed to the regenerator, where the coke deposits on the catalyst particles are burned off, with the objective of recovering the activity of the catalyst and to produce catalyst particles regenerated at high temperature, the heat of which is to a large extent consumed in the riser to fulfill the thermal demand for heating and vaporizing the feedstock and for the catalytic cracking reactions, which are predominantly endothermic.

The catalyst used for cracking a hydrocarbon feedstock may include any of the known catalysts that are used in FCC technology. The preferred catalysts are zeolites because of their intrinsically high activity and for their resistance to the deactivation effects of vapor exposure to high temperature and metals. Normally, zeolites are dispersed in an inorganic porous carrier such as silica, alumina or zirconium. The level of zeolite in the catalyst may reach 30% or more, by weight.

Although the present process may be used for feedstocks with different percentages of carbon residue, asphaltenes and metals, it is especially targeted at hydrocarbon feedstocks that have different levels of basic nitrogen, in other words, with at least 200 ppm of difference between the feedstock.

Feedstocks that may be feasibly processed using the present process are direct distillation heavy gas oil, vacuum gas oil and coker gas oil, deasphalted oils, atmospheric residues and vacuum residues, used alone or mixed in any proportion.

Hydrocarbon feedstock A is usually made up of heavy hydrocarbon streams with a boiling point of between 340° C. and 560° C. and an ° API of between 8 and 28.

A typical feedstock A for cracking as corresponds to the invention would be a vacuum treated heavy gas oil with a boiling point of between 380° C. and 540° C. and an ° API of between 15 and 22.

Heavy hydrocarbon feedstock B encompasses vacuum treated heavy gas oil, direct distillation heavy gas oil, atmospheric residue, vacuum residues, deasphalted oil, alone or mixed in any proportion.

Hydrocarbon feedstock B with a level of catalyst damaging basic nitrogen of between 1000 and 3500 ppm of b) is generally a heavy hydrocarbon stream with a boiling point of between 340° C. e 560° C. and an ° API between 8 and 28.

A typical heavy hydrocarbon feedstock B would be a deasphalted oil, with an initial boiling point of between 320 and 390° C. and an ° API of between 12 and 18.

The hydrocarbon feedstocks A of a) and B of b) are introduced into the each of the risers (7) and (8) at temperatures between 100 and 450° C. A typical temperature for introducing feedstocks is between 240 and 360° C.

So, according to the invention, feedstock B (with a higher level of catalyst damaging basic nitrogen) is routed towards a secondary riser (8), with a lower output, allowing the catalyst, in the main riser (7), with a higher output, to remain with a higher catalytic activity.

To avoid generating excessive coke in the secondary riser (8), which would compromise the catalyst/oil ratio in the main riser (7), a cooling fluid or other substance that will remove heat must be added in the secondary riser (8). Said fluid may be a light hydrocarbon fraction.

Following are described the steps of the process using as a base, the schematic drawing, FIG. 1 attached, that does not intend to limit the scope of the present invention, but rather to illustrate a possible configuration of the process based on the claims made for the present invention.

The FCC process of the present invention consists of a reactor (1), a regenerator (3), two elongated reaction zones or risers, (7) one main riser and (8) one secondary riser, that provide two zones for conversion. The circulation and contact of the catalyst with the feedstock proceeds as described below.

Therefore, two pipes (4 and 5) extend from out of the regenerator (3) through which the regenerated hot catalyst passes towards the conversion zones. The catalyst passes through duct (5) through the lower portion of the pipe (6) on the main riser, that is duct (7). The catalyst passes through duct (4) towards the lower pipe (9) of the secondary riser, that is duct (8). Fluidizing drag gas "gas lift", normally employed in FCC Units, with the purpose of accelerating the catalyst, is introduced through ducts (11), with one duct for each riser, entering into contact with the catalyst, in the lower pipes of the risers, maintaining the catalyst in a fluidized state. The distribution of the fluidizing drag gas in the lower pipes of the riser is performed preferentially by a perforated ring or even by a perforated plate. These typical distribution devices are familiar to experts in the field.

The regenerated hot catalyst will normally be at a temperature within a range of between 650 and 760° C. with a typical range of between 680 up to 732° C. as it leaves the ducts (4 and 5).

The residence time of the catalyst particles in the risers (7) and (8) varies between 1.3 and 8 seconds, preferably between 1 and 5 seconds.

Each riser (7) and (8) provides a conversion zone for cracking of the hydrocarbon feedstock. The conversion zone includes a vertical duct for pneumatic transport of the regenerated hot catalyst mixture coming from the regenerator with the feedstock. The feedstock is introduced into each riser (7) and (8), through injectors (12 and 13). Before contact with the catalyst, the feedstock presents a temperature of between 100 and 450° C., preferably between 240 and 360° C.

Reaction temperature is controlled in the upper part of each of the risers (7) and (8), usually within a range of 510 to 570° C., preferably between 520 and 560° C. This control is made through a conventional temperature measurement device, together with a controller and a signal transmission device that acts upon a control valve.

The present invention establishes that, given a different unit that processes a mixture of different feedstocks, such as, for example, mixtures of vacuum gas oil and coker gas oil, the feedstock richest in catalyst damaging basic nitrogen, in this case, coker gas oil, should be segregated and processed in riser (8), preferably with the lower diameter, in mixtures that contain varying amounts of coker gas oil (between 95 and 40% in volume), and of a cooling fluid (between 5 and 60% in volume) to remove heat in the referenced riser.

Simultaneously, the vacuum gas oil, in this case, the feedstock that must be poorer in basic nitrogen (by at least 200 ppm), should be fed into the main riser (7), preferably with the greater diameter, where it will be possible to maximize the conversion, as a function of avoiding the neutralization of the acid sites by the highly reactive basic nitrogen present in the coker gas oil.

It should be emphasized that the difference of 200 ppm less of basic nitrogen stipulated for the poorer feedstock destined for the main riser is only a reference limit that becomes attractive when feedstocks are segregated to be submitted to the new process. However, differences higher than 200 ppm, such as, for example, 500, 1000, 1500 ppm, or more, are preferable because they optimize the conversion and the selectivity of the process even more.

When dealing with feedstocks A and B made up of mixtures of different streams, if the present invention were to be applied, feeding mixture B is segregated from the high level of catalyst damaging basic nitrogen streams, in the secondary riser (8), together with a light stream that is responsible for removing heat from the secondary riser and feeding mixture A (which is a less contaminated stream) into the main riser (7), so as to maintain the level of basic nitrogen in segregated streams B, fed into secondary riser (8), with up to 3500 ppm more than the level of basic nitrogen present in streams A fed into the main riser (7).

The reacted mixture made up of the spent catalyst and the hydrocarbon vapors produced by the reaction are then discharged from the end of the riser, passing through the catalyst separation device, located inside the reactor and not shown in FIG. 1 since it is already very well known by technologists in the field. The separation device is normally a cyclone type, but any arrangement of the separators may be used to remove spent catalyst from the product stream. Hydrocarbons flow off towards duct (10), then is sent to the fractioning sections and to the recovery of the traditional products of catalytic cracking units, while the catalyst particles covered with coke (spent catalyst), flow towards rectifier (2), where vapor, running against the stream, removes the absorbed hydrocarbons on the surface of the catalyzer.

The rectified spent catalyst passes to regenerator (3), forming a fluidized bed, where coke is typically burned off of the surface of its particles by coming into contact with an oxygenized gas (usually air), that enters into regenerator (3) through an entrance in the bottom of the regenerator. Cyclone type separators, installed on the inside of the regenerator (due to its simplicity, it is not shown in FIG. 1), remove catalyst particles dragged by the combustion gas, returning them to the catalyst bed before the exit of the gas. Combustion of the coke catalyst particles heat the catalyst and the combustion gases.

The present invention will now be illustrated by the following example that should not be considered as a limitation of same.

Example 1

In a typical example, obtained through testing on an FCC pilot unit, simulating an operation with two risers, with a feedstock output of 720 g/h and the main data of operation of which are found in TABLE 1 below, the results are compared of a catalytic cracking of a feedstock made up of 70% vacuum gas oil and 30% deasphalted oil, that in the State of the Art system is cracked as a mixture, with the procedure performed according the present invention, where the feedstock is cracked with segregation of the feedstocks, in separate risers.

TABLE 1

| DATA | 70% HGO + 30% DESO (v/v) MIXTURE - Case A | HGO e DESO SEGREGATED - Case B |
|---|---|---|
| Temperature of the reaction, ° C. | 530 | 530 |
| C/O Ratio | | |
| riser 1 - main | 7.3 | 8.16 |
| riser 2 - secondary | 7.3- | 4.50 |
| Temperature of feedstock, ° C. | | |
| riser 1 - main | 225 | 220 |
| riser 2 - secondary | 225 | 290 |
| Yield, % by weight | | |
| Combustible gas | 6.8 | 5.4 |
| LPG | 15.6 | 16.1 |
| Gasoline | 37.9 | 39.0 |
| Light cycle oil (LCO) | 15.7 | 17.6 |
| Decanted oil | 17.6 | 15.0 |
| Coke | 6.4 | 6.9 |

In the column corresponding to Case A in TABLE 1 illustrative of the State of the Art, feedstock mixture is presented as a unit feedstock fed into two risers under the operational conditions described in the table. The temperature of the reaction is 530° C. In comparison, we have Case B, which is the proposal of the invention to crack segregated feedstocks A and B, in separate risers, simultaneously, maintaining the same reaction temperature in each riser, but with different feedstock temperatures.

As a consequence of the application of the process of the invention an increase is observed in the yield of LPG and gasoline and a reduction in the production of decanted oil and combustible gas, in this way maximizing the production of noble derivatives. The differences in yield between the Base Case (Case a) and an option of the present invention (Case B) are summarized in TABLE 2 below.

TABLE 2

| Yield, % by weight | Differences in yield from Case B in relation to Case B, points of % |
|---|---|
| LPG + Gasoline | +1.7 |
| Combustible gas | −1.4 |
| LCO | +1.9 |
| Decanted oil | −2.6 |

The principal characteristics of the feedstocks used in the Example are outlined in TABLE 3.

In the Example of the invention, beyond the profits from gasoline and LPG, a reduction in combustible gas is obtained and an increase in bottom conversion, for the reduction of decanted oil. The example shows that the alternative of freeing the acid sites of the catalyst fed into the main riser promotes greater selectivity in cracking of the main feedstock.

The profits of selectivity are possible with the process of the invention since stream B (richest in catalyst damaging basic nitrogen), upon being placed into the secondary riser (8), with a lower output, allows the catalyst to be preserved in the main riser (7), with a higher output, thus making an increase in conversion and greater selectivity possible.

It must be made very clear that according to the principles of the invention several refinements and improvements can be made, all within the spirit of the invention, in the sense of obtaining even greater profits than those explained in the descriptive report, such modifications include changing the reaction temperatures in each riser (7), (8) as well as cooling the base of the secondary riser (8) with a fluid such as water, to refine the removal of heat and increase the circulation.

TABLE 3

| | Feedstocks | | |
|---|---|---|---|
| Properties | HGO | Mixture (% v/v) HGO (70) + DESO (30) | DESO |
| Density, ° API | 17.8 | 17.8 | 16.3 |
| Density at 20/4° C. | 0.9442 | 0.9443 | 0.9535 |
| Aniline Point, ° C. | 90.2 | 92.6 | 109.8 |
| Distillation ASTM D-1160. ° C. | | | |
| PIE | 397.3 | 397.2 | 359.0 |
| 5% vol. | 412.3 | 416.9 | 477.8 |
| 10% vol. | 429.5 | 433.1 | 517.6 |
| 20% vol. | 451.2 | 450.4 | 555.5 |
| 50% vol. | 485.5 | 489.8 | — |
| 80% vol. | 52.4 | 534.3 | — |
| Total nitrogen, ppm | 3100 | 3200 | 3400 |
| Basic nitrogen, ppm | 1099 | 1172 | 1369 |
| Ramsbottom carbon residue, % weight | 1.03 | 1.13 | 4.00 |
| Pentane insoluble, % weight | 0.1 | 0.1 | <0.05 |
| Sulphur, % weight | 0.66 | 0.72 | 0.79 |
| Polyaromatic, % weight | 8.05 | 7.96 | 8.00 |
| Kinematic viscosity, cSt | | | |
| AT 60° C. | 177.7 | 203.6 | — |
| At 82° C. | — | — | 448.5 |
| At 90° C. | — | — | — |
| At 100° C. | 26.8 | 29.3 | 170.5 |
| Carbon 13. RMN (1) | | | |
| Carbon, % | 19.196 | — | 17.30 |
| Saturated carbon, % | 80.804 | — | 82.70 |
| Carbon - hydrogen, % | 8.023 | — | 6.786 |
| Carbon - methyl, % | 1.121 | — | 0.840 |
| Carbon - alkyl, % | 6.050 | — | 5.316 |
| Carbon, B, % | 4.002 | — | 4.358 |
| Carbon/hydrogen | 0.552 | — | 0.547 |
| Linear n-alkanes. % | 15.783 | — | 23.059 |
| Aromatic n-alkanes, % | 11.012 | — | |
| Metals, ppm | | | |
| Nickel | <1.0 | <1.0 | <1.0 |
| Vanadium | 1.6 | 1.8 | 4.0 |
| Sodium | 1.4 | 2.0 | 2.8 |

Note:
(1) Nuclear magnetic resonance.

The considerations and the results of Example 1 above prove that the process of the invention provides an optimization in cracking conversion selectivity rates when the stream that is richest in catalyst damaging basic nitrogen is segregated to be injected into a riser with a lower output (8), because it leaves the main riser (7) catalyst active to function for more time in one feedstock with a higher output and with a lower amount of basic nitrogen.

What is claimed is:

1. A process for fluid catalytic cracking of hydrocarbon feedstocks with high levels of basic nitrogen, in a multiple riser FCCU, operating with feedstocks A and B, wherein the process comprises the following steps:

a) placing in contact with a zeolite catalyst, in a main riser of the FCCU, a hydrocarbon feedstock A which possesses a level of basic nitrogen at least 200 ppm lower than feedstock B that is being processed in a secondary riser of the FCCU;

b) simultaneously, placing in contact with the zeolite catalyst, in the secondary riser of the FCCU, a hydrocarbon feedstock B comprised of a mixture made up of between 95 and 40%, in volume, of hydrocarbon streams with a content of catalyst-damaging basic nitrogen of between 1000 and 3500 ppm, and between 5 and 60%, by weight, of a cooling fluid capable of increasing a circulation in the secondary riser and of cooling a regenerator, in order to adjust the thermal balance of the FCCU and maintain a circulation of the catalyst in the main riser, at proper levels, so that a catalyst/oil ratio remains in a range of between 4.5 and 8.5;

c) maintaining the operation of the FCCU within the conditions of catalytic cracking;

d) recovering from a tube products of the cracking reaction with an increase in conversion of bottom fractions, a greater proportion of gasoline and LPG, at the same time with a lower proportion of coke and combustible gas;

e) recovering from a catalyst separation device spent catalyst and passing the spent catalyst to a regenerator for removing coke from the spent catalyst and regenerating the zeolite catalyst; and f) separating the regenerated zeolite catalyst; and g) passing the regenerated zeolite catalyst to the main riser and the secondary riser wherein the regenerated zeolite catalyst is extracted from a single zone within the regenerator.

2. The process according to claim 1, wherein the FCCU includes a main riser and two secondary risers.

3. The process according to claim 1, wherein the FCCU includes a main riser and three or more secondary risers.

4. The process according to claim 1, wherein said hydrocarbon feedstock A comprises a heavy hydrocarbon stream with a boiling point of between 340° C. and 560° C. and an ° API of between 8 and 28.

5. The process according to claim 4, wherein the heavy hydrocarbon flow stream of feedstock A comprises vacuum treated heavy gas oil, direct distillation heavy gas oil, atmospheric residue, vacuum residue, deasphalted oil, or a mixture of any proportion thereof.

6. The process according to claim 5, wherein a heavy hydrocarbon stream of feedstock A is a vacuum-treated heavy gas oil with a boiling point of between 380° C. and 540° C. and an ° API of between 15 and 22.

7. The process according to claim 4, wherein the heavy hydrocarbon flow stream of feedstock A comprises isolated streams and mixtures between streams that have levels of catalyst damaging basic nitrogen of between 200 and 3500 ppm.

8. The process according to claim 1, wherein hydrocarbon feedstock A possesses a level of basic nitrogen of at least 500 ppm lower than feedstock B that is being processed in the secondary riser of the FCCU.

9. The process according to claim 1, wherein hydrocarbon feedstock A possesses a level of basic nitrogen at least 1000 ppm lower than feed B that is being processed in the secondary riser of the FC0U.

10. The process according to claim 1, wherein hydrocarbon feedstock A possesses a level of basic nitrogen 3500 ppm lower than feedstock B that is being processed in the secondary riser of the FCCU.

11. The process according to claim 1, wherein the catalyst is a conventional zeolite type for FCC processes of heavy feedstocks containing basic nitrogen, with around 30% zeolite dispersed in an inorganic porous carrier.

12. The process according to claim 1, wherein feedstock B of hydrocarbons with levels of catalyst-damaging basic nitrogen of between 1000 and 3500 ppm is a heavy hydrocarbon stream with a boiling point of between 340° C. and 560° C. and an ° API of between 8 and 28.

13. The process according to claim 12, wherein said heavy hydrocarbon stream of feedstock B comprises vacuum treated heavy gas oil, direct distillation heavy gas oil, atmospheric residue, vacuum residue, deasphalted oil, or a combination of any proportion thereof.

14. The process according to claim 13, wherein one of said heavy hydrocarbon stream of feedstock B to be a deasphalted oil, with an initial boiling point of between 320 and 390° C. and an ° API of between 12 and 18.

15. The process according to claim 1, wherein the cooling fluid in the secondary riser of b) is a light hydrocarbon stream with boiling point between 32 and 350° C. and with a density at 20/4° C. of between 0.7 and 1.

16. The process according to claim 15, wherein a light hydrocarbon stream is added in proportion of between 5 and 60% by volume of the total stream B.

17. The process according to claim 1, wherein the cooling fluid of the secondary riser is an inert stream.

18. The process according to claim 17, wherein said inert stream is water in proportion of between 5 and 10% by volume of the total stream B.

19. The process according to claim 1, wherein the hydrocarbon feedstocks A and B are introduced into the main riser and the secondary riser at temperatures between 100 and 450° C.

20. The process according to claim 19, wherein hydrocarbon feedstocks A and B are introduced into the main riser and the secondary riser at temperatures of between 240 and 360° C.

21. The process according to claim 1, wherein reaction temperatures in the main riser and the secondary riser are controlled at between 510 and 570° C.

22. The process according to claim 21, wherein reaction temperatures in main riser and the secondary riser are controlled at between 520 and 560° C.

23. The process according to claim 1, wherein the regenerated catalyst which leaves the regenerator to enter into the main riser and the secondary riser to be at temperatures of between 650 and 750° C.

24. The process according to claim 23, wherein the regenerated catalyst which leaves the regenerator to enter into the main riser and the secondary riser to be at temperatures of between 680 and 732° C.

25. The process according to claim 1, wherein the residence time of the catalyst particles, in the main riser and the secondary riser fluctuates between 0.3 and 8 seconds.

26. The process according to claim 24, wherein the residence time of the catalyst particles, in the main riser and the secondary riser fluctuates between one and five seconds.

* * * * *